United States Patent [19]

Peterson

[11] 4,016,735

[45] Apr. 12, 1977

[54] RANGE CONTROL FOR AN AUTOMATIC GAUGE CONTROL SYSTEM OF A ROLLING MILL

[75] Inventor: Robert S. Peterson, Williamsville, N.Y.

[73] Assignee: Westinghouse Electric Corporation, Pittsburgh, Pa.

[22] Filed: Sept. 23, 1975

[21] Appl. No.: 616,109

[52] U.S. Cl. ..... 72/9; 72/17

[51] Int. Cl.[2] ..... B21B 37/06

[58] Field of Search ..... 72/6–10, 72/16, 19, 17, 205

[56] References Cited

UNITED STATES PATENTS

| | | | |
|---|---|---|---|
| 3,049,036 | 8/1962 | Wallace et al. | 72/9 |
| 3,062,078 | 11/1962 | Hulls | 72/205 X |
| 3,089,365 | 5/1963 | Wallace et al. | 72/237 X |
| 3,492,844 | 2/1970 | Silva | 72/8 |
| 3,531,961 | 10/1970 | Dunn | 72/8 |
| 3,782,151 | 1/1974 | Peterson et al. | 72/9 |

*Primary Examiner*—Milton S. Mehr
*Attorney, Agent, or Firm*—C. M. Lorin

[57] ABSTRACT

In a single-stand, or multi-stand rolling mill, when the automatic gauge control circuit controlling the roll speed of one stand saturates, the gauge delivery of such stand is altered by changing the roll gap of the stand in such a way as to restore normal operation of the automatic gauge control out of saturation.

2 Claims, 13 Drawing Figures

TO FAST RAMP FUNCTION GENERATOR
FROM MULTIPLIER 38
R1
R2
OA1
OA2
102
103
39
42
43
45

TO SUMMER 87
FROM CALIBRATION 44
FROM ISOLATION AMPLIFIER 61
LIMITER
R4>>R2
R2
R3
R4
C4
X
40 INTEGRATOR
47 INVERTER
46 SUMMER
50
45
62
63
64

10 VOLTS @ MAX DRIVE SPEED
R1
R2
R3
OA1
OA2
PT2
R2<R1
29
64

RANGE CONTROL FOR AN AUTOMATIC GAUGE CONTROL SYSTEM OF A ROLLING MILL

BACKGROUND OF THE INVENTION

This invention relates in general to automatic gauge control for a rolling mill.

It is known in a rolling mill to measure the gauge of a strip of material being rolled after it has passed through the work rolls of a stand and to use an automatic gauge control system responsive to a gauge error so detected in order to modify the speed at which the strip is being fed into the stand, thereby to correct for the gauge error.

It is also known in a multi-stand rolling mill to use two automatic gauge control systems, one at the delivery end with a gauge error being measured after the last stand, the other at the entry to regulate the strip gauge when leaving the first or the second stand.

The present invention relates more particularly to automatic gauge control at the entry of a rolling mill.

Automatic gauge control is usually conducted with a predetermined, or normal, strip tension between the stands. When the interstand tension becomes too high, or too low, due to variations in the mill set-up, or in the incoming product, the automatic gauge control system becomes unable to regulate the gauge and additional means are necessary to control the gauge. U.S. Pat. No. 3,782,151 of R. S. Peterson et al, issued Feb. 29, 1972 discloses range control means associated with an automatic gauge control system and activated, when there is an out-of-range tension condition, to bring the tension between the last two stands within the limits of control.

In the aforementioned Peterson patent, for normal interstand tension the delivery gauge is regulated by adjusting stand speed at the last stand through a tension regulator, and an out-of-range condition is corrected by adjusting the speeds of several stands directly through a range control device.

Range control correction at the entry of the rolling mill involves tension between the two first stands and the corrective mode is necessarily different from what is needed at the delivery end. An interstand corrective loop may be provided between the first stands as suggested in U.S. Pat. No. 3,507,134 of A. V. Silva. The tension is then automatically adjusted to the desired value by sensing intertension error with a tensiometer and applying a corrective signal to the screwdown system of the next, or the preceding stand. However, such loop does not provide any direct response to gauge variation.

Strip gauge error is generally corrected by screwdown correction to a stand preceding the location of the gauge sensing device. This technique is disclosed in U.S. Pat. No. 3,492,844 of A. V. Silva. The U.S. Pat. No. 3,492,844 of Silva shows how gauge correction by screwdown speed control is sensed after a time delay corresponding to transport time from the roll bite of the stand to the location of the X-ray gauge. Also the patent shows an automatic adjustment of the corrective gain to the size of the gauge error.

As required by the constant mass flow of metal through the stands of a multi-stand rolling mill, roll gaps and the speeds of the stand are maintained in a proper relation between each other throughout the mill. Therefore, an automatic gauge control (AGC) system on the mill operates only for a small fraction of the stand top speed, typically ± 10%. Whenever an excessive correction is demanded by the system, the AGC saturates and no further correction can be made. For the same reason an additional correction by stand speed is not desirable at the entry of the rolling mill since it would affect the operation of all the succeeding stands.

SUMMARY OF THE INVENTION

The present invention relates to a rolling mill having at least one roll stand fed with strip material, the delivery gauge of which is sensed after said one roll stand and automatically controlled by an automatic gauge control system responsive to the sensed gauge. The invention resides in modifying the roll gap of said one roll stand in response to an out-of-range condition detected at the output of said automatic gauge control system in a direction to eliminate said out-of-range condition; whereby said automatic gauge control system is rendered operative again to correct any sensed gauge error.

The present invention more specifically proposes to correct any gauge deviation which is outside the range of the automatic gauge control system at the entry of a rolling mill by corrective action on the roll stand screwdown mechanism so as to restore normal AGC operation. In a multistand rolling mill, the gauge deviation is preferably sensed after the second stand, and the screws of the first stand are moved in the proper direction. A gauge change is thus caused to appear in the strip after stand 1, which change in turn causes a change in tension between stand 1 and stand 2. The roll force of stand 2 is therefore affected and the mill stretch changes in the direction to correct the strip gauge after stand 2. The resulting strip gauge change leaving stand 2 will be in a direction to cause the entry AGC by speed to come out of saturation. The strip error created by the range control will probably be in the direction to initially cause gauge error. However, the entry AGC by speed operates now in its range of control. Since AGC by speed is very much faster than AGC by screwdown, the gauge error introduced during range control is rapidly sensed and corrected. Therefore, range control in accordance with the present invention causes negligible gauge error after stand 2, while keeping the entry AGC by speed within its operating range.

DESCRIPTION OF THE PREFERRED EMBODIMENT

Figure 1:
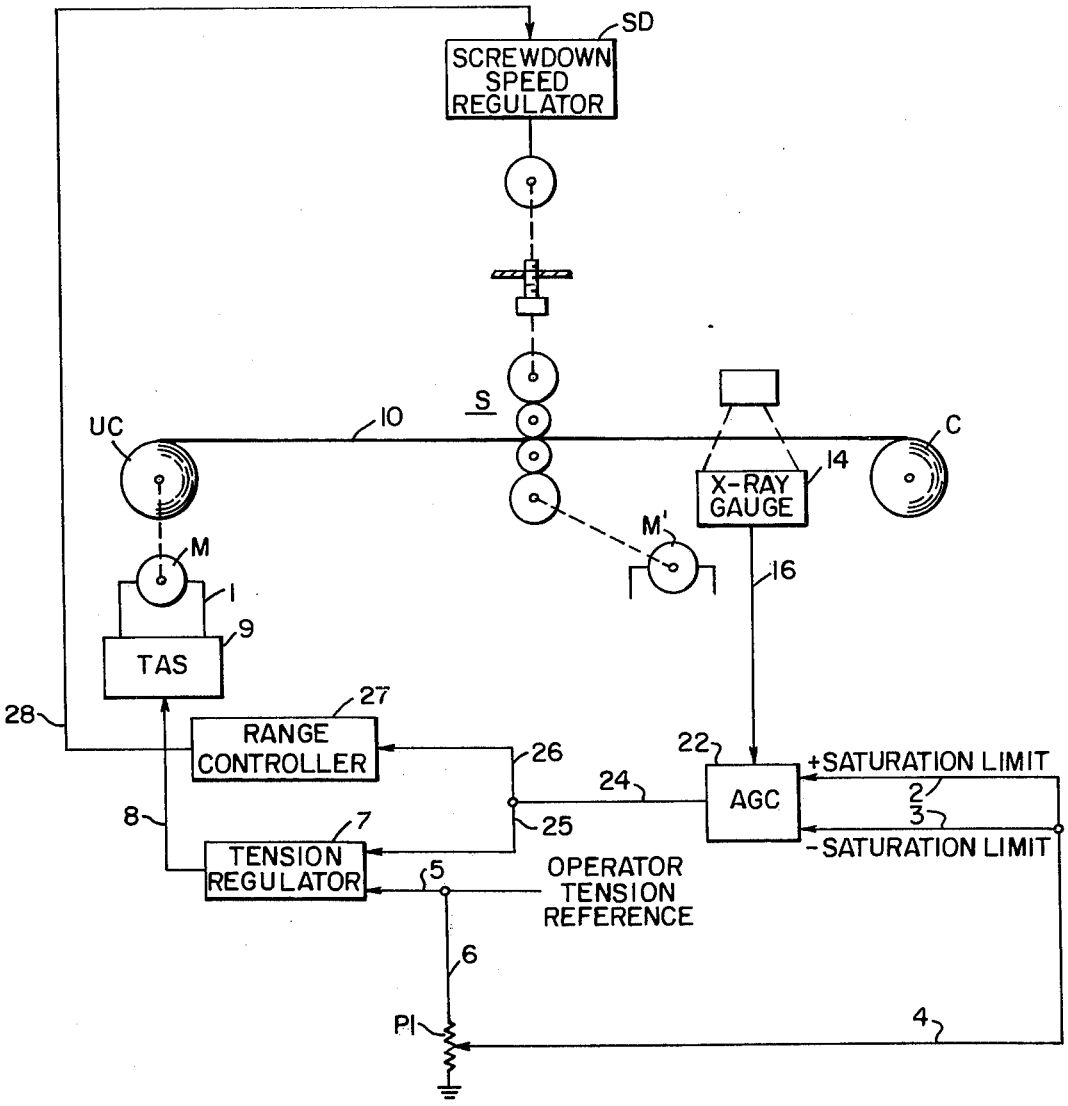
FIG. 1 shows a single stand rolling mill embodying the automatic gauge control system according to the present invention.

With reference to FIG. 1 of the drawings, a single stand rolling mill is shown. Stand S has roll members into which a strip of material 10 is fed from an uncoiler UC. At the delivery side of stand S a coiler C receives the strip. A gauge device 14 placed after stand S provides a gauge error signal on lead 16 to an automatic gauge control circuit 22 which is in the nature of a controller by back tension on the strip. The output lead 24 from the AGC circuit 22 is connected to the input lead 25 of a tension regulator 7 which compares the desired tension signal on line 25 with a tension reference on line 5. A control signal is derived by tension regulator 7 on output lead 8, and the signal is used to control a thyristor armature supply 9 generating armature current on line 1 of motor drive M coupled to the uncoiler UC. Should the gauge sensed by gauge device 14 deviate from the desired value, the automatic gauge control circuit 22 causes the speed of motor M to change thereby to modify the tension of the strip at the entry of stand S. Stand S is driven at a predetermined speed N and the correction mechanism of stand S is such that for a given tension in the strip fed to the stand, the roll gap, taking into account the mill stretch of the mechanism and rolls, will be $h$, the product $h \times N$ being the mass flow through the stand. Therefore, any tension change caused by a change in speed of the motor driving the uncoiler UC will cause a change in the roll gap of the roll member, resulting in a change of gauge at the delivery end.

Normally, the automatic gauge control circuit 22 responds to gauge error sensed by gauge 14 to keep the strip on gauge by automatic adjustment of the metal feed at the entry of the stand. Moreover, when so doing, the automatic gauge control circuit operates only on a fraction of the strip gauge, for instance 10% of the overall thickness. Should, however, the gauge discrepancy detected by gauge device 14 become excessive, the automatic gauge control circuit 22 no longer is able to provide the necessary gauge correction. As a matter of fact, there is a limit in the acceptable tension change through acceleration, or deceleration of the uncoiler for a given mill stand speed and roll gap. Also the automatic gauge control circuit 22 has an inherent range of operativeness, which cannot be exceeded.

As shown in FIG. 1, from the tension reference, which may be set by an operator on line 5, is derived via line 6, potentiometer $P_1$ and line 4, a potential applied to the AGC circuit 22 on leads 2 and 3 for establishing within circuit 22 two levels of saturation of opposite polarities. Whenever circuit 22 saturates, a characteristic signal appears at the output on lead 24 which on line 25 and by comparison with the tension reference on line 5 fixes the limit of control by tension regulator 7. An out-of-range condition is thus sensed on line 24, which via line 26, is used as an input to a range controller 27, the function of which is to generate a control signal at the output which is used for corrective action via lead 28 and the screwdown control mechanism SD of the roll stand. Therefore, should an out-of-range condition be established on leads 24, 26, the roll gap is modified by screwdown so as to change the gauge of the strip. The gauge change must be such that the gauge error detected by gauge device 14 lies again within the range of the AGC circuit 22. Thus, the out-of-range condition on lead 26 disappears, and normal gauge correction capability by tension regulation is restored.

Figure 2:
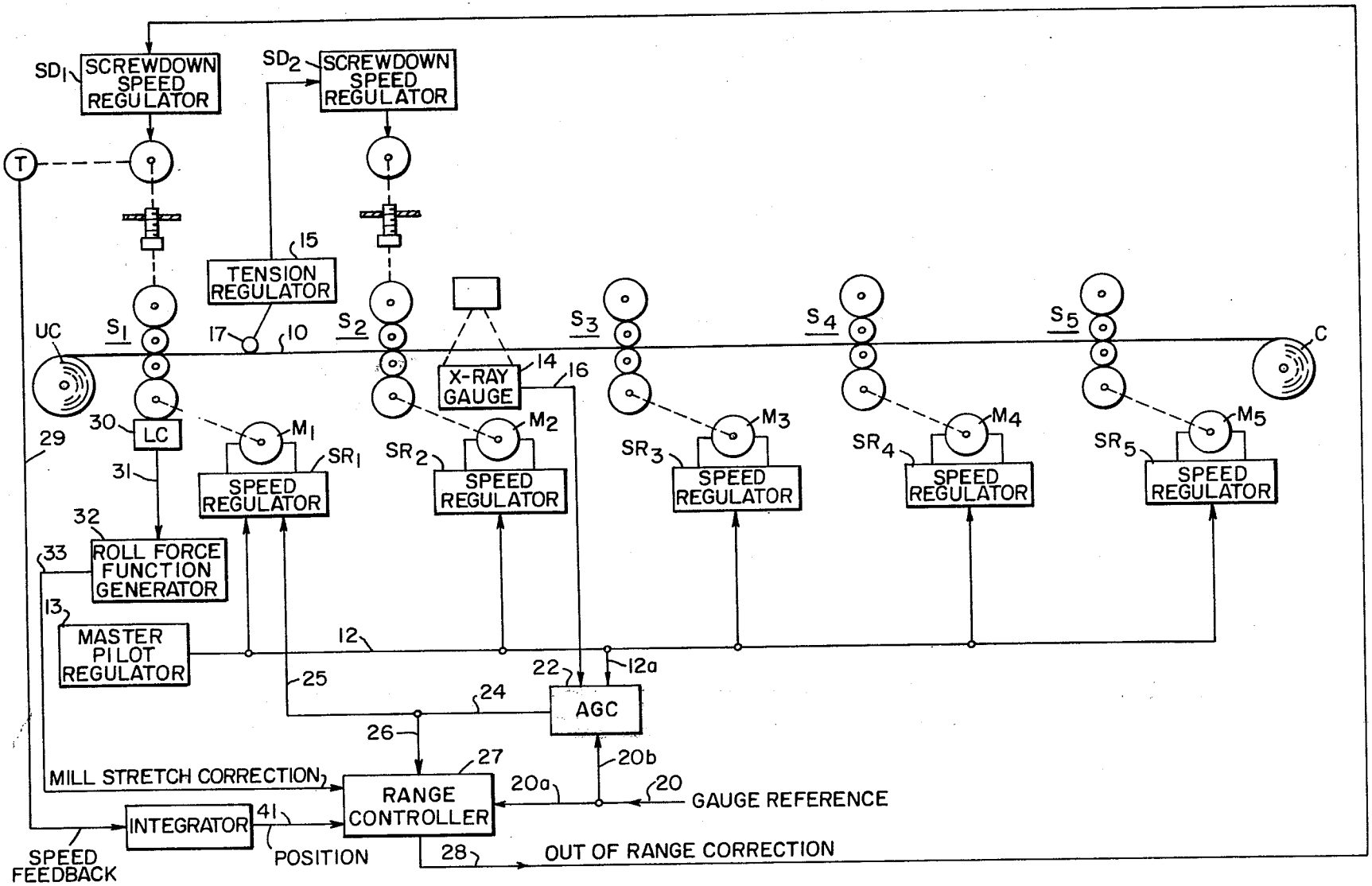
FIG. 2 shows a multi-stand rolling mill embodying the automatic gauge control system according to the present invention.

With reference to FIG. 2, a five-stand tandem rolling mill is shown including five stands $S_{1_1}$, $S_{2_1}$, $S_4$ and $S_5$. Strip material passes between the rolls of successive stands $S_1$–$S_5$ and is progressively reduced in gauge while the speed of the strip material increases successively at the output of each stand. The rolls of each stand are provided with drive motors, only motors $M_1$, $M_2$, $M_3$ being shown in FIG. 1. Motors $M_1$–$M_3$ are controlled by speed regulators $SR_1$, $SR_2$ and $SR_3$, respectively, which receive a master speed reference signal on lead 12 from master pilot regulator 13. Additionally each stand is provided with a screwdown mechanism and screwdown control, only the screwdown $SD_1$ for stand $S_1$ and screwdown $SD_2$ for stand $S_2$ being shown in FIG. 1. The screwdown $SD_2$ for stand $S_2$ can be controlled by stand $S_2$ tension controller 15 which receives a tension signal from tensiometer 17 in contact with the strip 10 between stand $S_1$ and $S_2$. If the tension between stand $S_1$ and $S_2$ should rise above or fall predetermined maximum and minimum values, corrective action is taken through the screwdown $SD_2$ to either increase or decrease the roll bite opening of stand $S_2$ to such an extent that the tension between stands $S_1$ and $S_2$ is again within permissible limits.

The gauge of the strip material issuing from the second stand $S_2$ is measured by an X-ray gauge 14, or the like, which produces a signal on lead 16 proportional to actual gauge. The signal from X-ray gauge 14 is compared at summing point 18 with a gauge reference signal on lead 20 determined by the operator of the roll, or possibly by a computer. The gauge reference signal is proportional to the gauge desired to be delivered by stand $S_2$ in consideration of the overall mass flow condition established by the successive roll gaps and stand speeds in relation with the final delivery gauge aimed at. If the actual gauge signal on lead 16 is not equal to the reference gauge signal on lead 20, a gauge deviation signal is developed which is is developed which is applied to an automatic gauge control circuit 22, the details of which will be explained hereinafter.

Essentially, the function of the automatic gauge control circuit 22 is to apply a control signal developed at its output on leads 24 and 25 to the speed regulator $SR_1$ of stand $S_1$ so as to vary the speed of motor M, thus of the roll members. Therefore, the tension between stands $S_1$ and $S_2$ is changed, and this tension change affects the roll force at stand $S_2$ , thus the delivery gauge of stand $S_2$. Since there is a delay (transport time) between the correction effected by stand $S_1$ under the speed regulator $SR_1$ and the effective gauge change detected by the X-ray gauge, the gain of the gauge control loop in the automatic gauge control by speed is varied as a function of transport time. The function of this stand speed control loop is well known. In the U.S. Pat. No. 3,782,151 of Peterson et al, a typical automatic gauge control is described and the description found in FIG. 2 of this patent is hereby incorporated by reference for the purpose of the present description of the automatic gauge control circuit 22 of FIG. 1.

Since the automatic gauge control circuit 22 performs correction for typically 10% of the strip gauge, it normally operates only within a limited range, above and below the normal and desired gauge. Thus, for maximum and minimum deviations about the reference value indicated by the lead 20, the AGC circuit 22 saturates and no larger operative signal can appear on line 25.

When the automatic gauge control circuit 22 saturates, the signal at the output, on lead 24 is maximum or minimum. In accordance with the present invention, a range controller 27 is provided which is responsive to such saturation condition on line 24 and also on line 26 derived therefrom. The range controller 27, in some respects, is similar to the range control circuit 36 of FIGS. 1 and 2 in the aforementioned U.S. Pat. No. 3,782,151 of Peterson et al, and the text of this Peterson et al patent is hereby incorporated by reference for the purpose of describing the range controller according to the present invention, unless specifically stated otherwise therein. When activated by the limit condition of the AGC circuit 22, appearing on lead 26, range controller 27 generates at its output, on lead 28, a control signal representing an out-of-range correction which is applied to the screwdown mechanism $SD_1$ of stand $S_1$. A feedback loop is provided over lead 29 via a tachometer T, representing screwdown speed of the screw in motion, and a feedback input of the range controller 27.

Moving stand 1 screws a given distance does not mean that the roll gap has changed by this amount, because the roll force at stand $S_1$ is changed and therefore the mill stretch also changes. Compensation for the change in mill stretch of the stand can be obtained by action on the screws from a determination of the actual mill stretch, which data can be derived from a measurement of the actual roll force. Accordingly a load cell (LC) 30 is provided on stand $S_1$ which supplies a signal indicative of roll force on lead 31. A roll force function generator 32 is shown in FIG. 1 which transfers the roll force measurement into a mill stretch signal on line 33. The latter is applied for mill stretch correction to the input of range controller 27.

The stand $S_1$ entry AGC circuit 22 normally applies a speed correction signal to the main drive $M_1$ of stand $S_1$ through speed regulator $SR_1$ thereby to correct strip gauge error as measured by gauge 14 after stand $S_2$. The strip gauge is primarily corrected in the roll bite of stand $S_2$. This is accomplished by varying the speed of stand $S_1$ which changes the strip tension between stand $S_1$ and $S_2$, which in turn changes roll force on stand $S_2$. When stand $S_2$ roll force is changed, the mill stretch changes in the direction to correct the strip gauge error after stand $S_2$. If there is a change in strip tension of stands $S_1$, $S_2$ exceeding a preset amount, tension regulator 15 normally will sense the change in strip tension and control screwdown $SD_2$ so as to move the screws on stand $S_2$ in the direction to prevent interstand 1–2 tension from becoming too high or too low. Stand $S_2$ screw movement will be in the direction to change stand $S_2$ roll gap to correct the strip gauge error leaving stand $S_2$. However, such tension change is of another order than any change in tension due to operation of the AGC circuit 22.

The AGC circuit 22 includes a correction amplifier which is only allowed to change the speed of stand $S_1$ by a maximum amount, typically ±10% top speed. When the AGC circuit 22 is called on lead 16 to make a greater speed change, saturation occurs and no further correction can be made by speed regulator $SR_1$ to bring the strip leaving stand $S_2$ on gauge. In such case, special control is provided to initiate other mill action until the entry AGC by speed is again out of saturation. This is accomplished in accordance with the present invention by moving the screws of stand $S_1$ in a direction such as to create a gauge change in the strip leaving stand $S_1$ which in turn will change the strip gauge leaving stand $S_2$. The strip gauge change leaving stand $S_2$ will be in the direction to cause the entry AGC circuit 22 to come out of saturation. The action of such control will probably result in a small gauge error. However, since the entry AGC by speed is very much faster than the entry AGC range control, it rapidly senses this small gauge error and correction of the gauge of the strip leaving stand $S_2$ is performed immediately. Thus control according to the present invention to bring the AGC circuit 22 back within operative control range causes only a negligible gauge error after stand $S_2$, which error can be corrected again by normal operation of the AGC circuit 22 and speed regulator $SR_1$ within the operative range.

Figure 3:
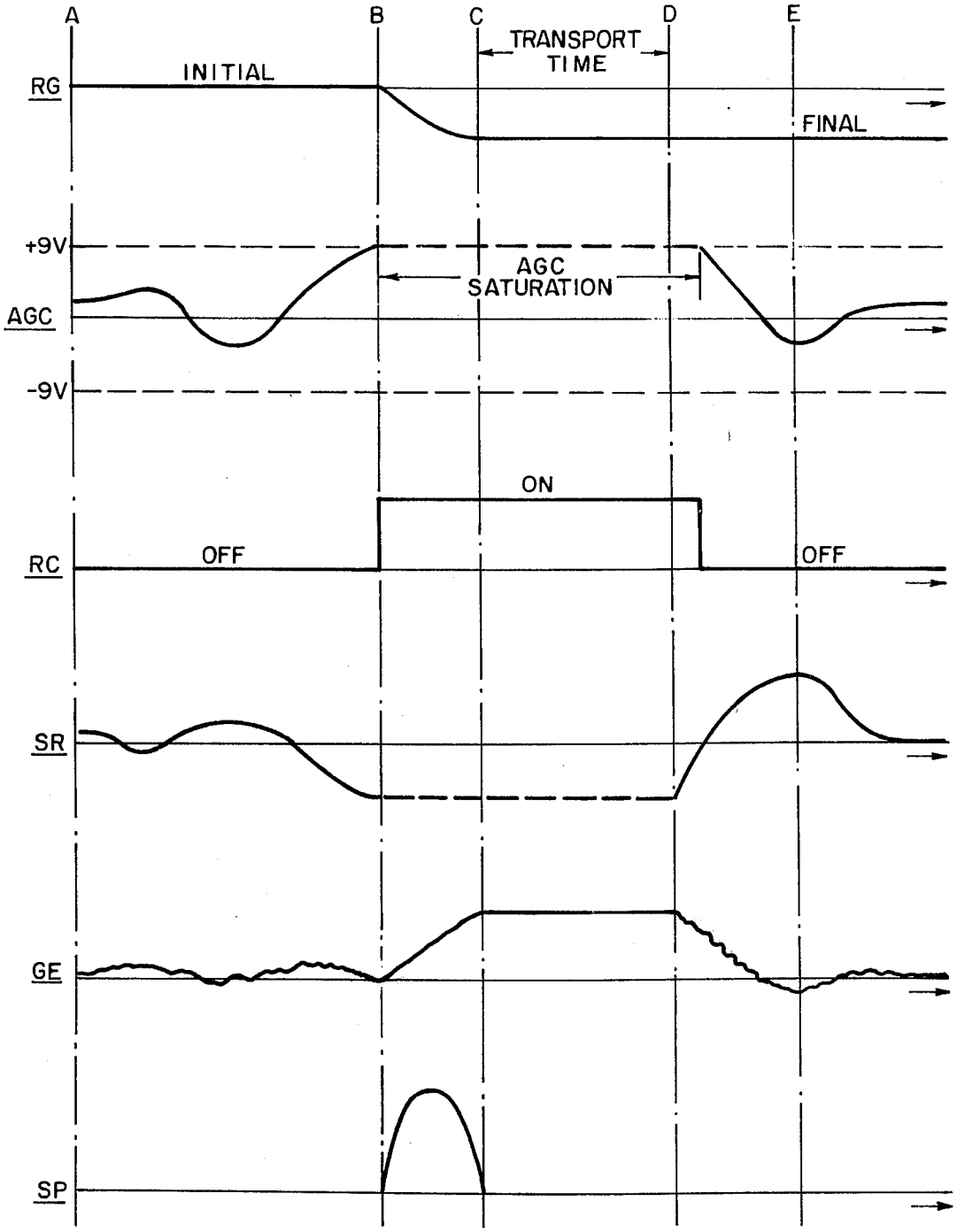
FIG. 3 shows six curves employing the operation of the control system according to the invention.

The operation of the automatic gauge control circuit 22 and the range controller 27 is best understood by reference to FIG. 3. FIG. 3 shows six curves which are characteristic of several phases in the operation of the circuit of FIG. 2.

Curve (RG) represents the screw setting of stand $S_1$ under the effect of the screwdown mechanism $SD_1$. From A to B the screwdown mechanism defines a screw setting in relation to stand speed which provides the expected strip gauge. As is well known, the screw setting is not a direct measurement of the roll gap. Rather, the roll force and the mill stretch modifies the relation in accordance with gauge changes and hardness variations in the workpiece being rolled. Curve (GE) represents gauge error as sensed by gauge device 14. From A to B, curve (GE) shows the corrective action due to speed regulation in the loop including the AGC circuit 22, speed regulator $SR_1$ and master pilot regulator 13. During this phase the output of the AGC circuit 22, on line 24 is between the two saturation limits, typically +9 volts and −9 volts, as indicated by curve (AGC), which represents the output voltage of the AGC circuit 22.

During the same period AB of control, speed regulator $SR_1$ has an output on line 25 such as indicated by curve (SR). With a delay corresponding to the transport time, the gauge error detected during normal control is as shown by curve (GE).

At point B the AGC circuit 22 saturates and, as shown by curve (RC), the range controller output assumes a saturation level shown to last from B to D. Since the automatic gauge control circuit beyond B is unable to control the speed regulator $SR_1$, a gauge error builds up as shown by curve (GE). However, operation of the range controller 27 causes the screw setting of stand $S_1$ to change as shown by curve (RG) from an initial gap to a final gap progressively from B to C, the screw setting in turn changes the roll gap. Allowing for transport time from C to D, the effect of such roll gap change appears as gauge correction from D to E on curve (GE). Screwdown correction is relatively slow. Roll gap action has overcorrected the gauge error existing between C and D. However, as soon as screwdown action has brought the AGC circuit 22 out of saturation, speed regulator $SR_1$ energizes correction of its own as shown by curve (SR). The cumulative effect of such correction appears on curve (GE) tending to bring the strip on gauge beyond point E as it was before point B. Curve (SP) indicates, between B and C, the effect of the screw speed feedback loop.

Figure 4:
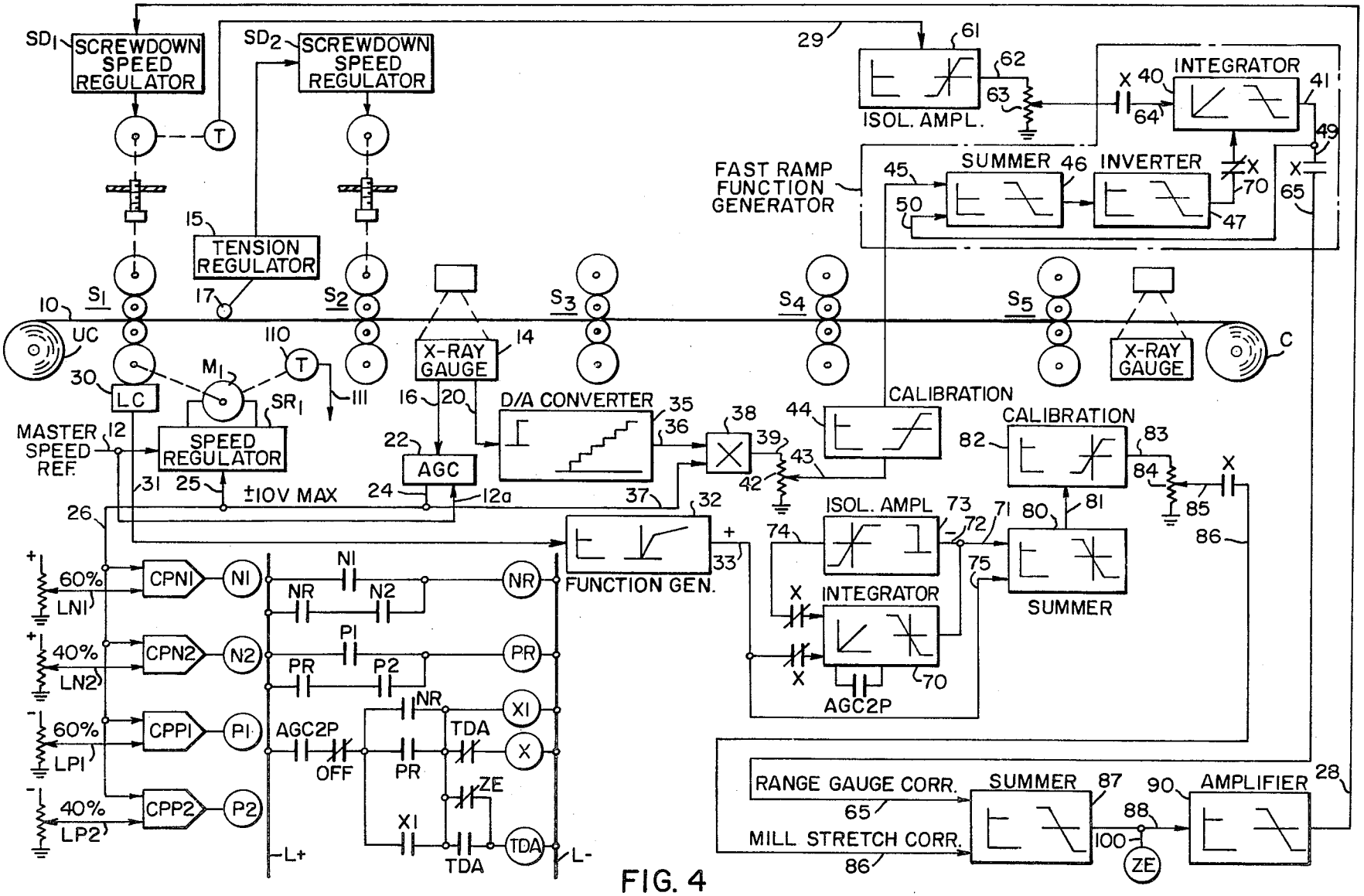
FIG. 4 gives an overall view of the preferred embodiment of the present invention.

FIG. 4 shows in block diagram the overall apparatus for the preferred embodiment of the present invention. Typical circuits which can be used in carrying out the invention are shown by reference to FIG. 4 in subsequent Figures of the drawings.

The preferred embodiment will be described in the context of a multi-stand rolling mill. FIG. 4 shows stands $S_1$–$S_5$ between a payoff reel UC and a tension reel C. The strip of material 10 passes successively through each stand with increasing speed and decreasing roll gaps. An X-ray gauge is disposed after stand $S_2$ at 14. A load cell LC detects the roll force at stand $S_1$. Each roll stand is driven by a motor drive. Only one, motor $M_1$ for $S_1$ is shown, and a speed regulator $SR_1$ controls the speed of motor $M_1$, thus the rolling speed of stand $S_1$, by reference to a master speed reference signal on lead 12. A tensiometer 17 is in contact with the strip 10 between stands $S_1$ and $S_2$ to derive a signal representative of the intertension. Tension regulator 15 generates a control signal for adjusting the screwdown controller $SD_2$ of the screwdown mechanism of stand $S_2$. From gauge 14, after stand $S_2$, a signal is derived representing gauge error, applied via lead 16 to an automatic gauge control circuit 22 which controls, via line 25, the speed of the main drive $M_1$ of stand $S_1$, concurrently with the master speed reference signal on line 12. All this is conventional technology. For a detailed description of the automatic gauge control circuit 22, reference may be had to U.S. Pat. No. 3,740,983 of Robert S. Peterson and John W. Cook of June 26, 1973, and the description made in this patent is hereby incorporated by reference, the automatic gauge control circuit 22 herein being the same unless hereafter stated otherwise. Thus, normally for a gauge reference selected on the X-ray gauge 14 and derived on lead 20 therefrom, the gauge error is derived on line 16 and applied as input to the AGC circuit 22.

In the AGC circuit the actual and desired gauge signals are compared and summed up so as to develop an error signal which is applied to an error compensation amplifier to produce an output linear signal which varies above or below a zero reference, depending upon the magnitude and polarity of the input error signal. Included in the AGC circuit 22 is an amplifier having connected between input and output a variable limiter which limits the maximum output to, typically ± 10 volts, which represents typically 10% of stand $S_1$ speed setting. Between the two saturation states of the AGC circuit 22, the speed of stand $S_1$ is automatically regulated by a maximum amount, typically of ±10% of stand $S_1$ operating speed. When the AGC circuit tries to call for a greater speed change, the AGC circuit 22 saturates and no further correction by stand $S_1$ is made through the speed regulator $SR_1$.

In such event, an out-of-range condition is exhibited on lead 24 at the output of the AGC circuit, which condition is carried via line 26 to out-of-range detectors NR and PR by a circuitry, shown on FIG. 4, such that detector PR (positive voltage out-of-range), or detector NR (negative voltage out-of-range), picks up typically at approximately 60% of the maximum saturation level of the AGC circuit 22 and is deenergized only beyond a threshold of 40% of such maximum saturation level. This deadband is such that normally, and except when the AGC system is initially turned on, the fast entry AGC by speed system is always able to regulate the strip gauge coming out of stand $S_2$.

When out-of-range control is required, relay PR, or NR, causes energization of relay X and certain circuitry, now to be described, is put into operation.

As shown in FIG. 4 from the X-ray gauge device 14 a signal is derived on lead 20 representing the gauge reference, usually provided in digital form. The signal on lead 20 corresponds to the gauge of the product being worked on the mill at a given time. A digital-/analog converter 35 provides on line 36 an analog signal characteristic of the desired gauge. For instance, 10 volts represent the maximum strip gauge expected on the X-ray gauge 14. On lead 37 is derived from the output of the AGC circuit, a signal representing the polarity of the saturated state thereof. Multiplication of these two signals in multiplier 38 provides on line 39 a signal having a sign characteristic of the direction of the required correction.

From potentionmeter 42 and lead 43 a fraction of the correction signal is derived, which is used as an input to a calibration circuit 44. At the output of circuit 44 a voltage is derived having the proper calibration in volt-/mill correction. The calibrated correction signal is used as one input to a fast range function generator including successively a high gain summer 46, an inverter 47 and a position loop integrator 40. The output on lead 41 is returned via line 50 to a second input of the summer 46, so that the output on line 41 establishes itself at a slowly fluctuating level.

From the screw tachometer T of stand $S_1$ a signal on line 29 is fed into an isolation amplifier 61 to provide a signal representing motion of the screws. Such signal on line 62 at the output is derived from potentiometer 63 and passed through contacts, usually open, of relay X to lead 64 into a second input of position loop integrator 40 where screw speed is converted into screw position. Whenever there is an out-of-range condition, relay X is energized, as explained elsewhere therein, contacts on lead 64 are closed and contacts on lead 70 are open. As a result the reference signal stored in integrator 40 via feedback line 50 is summed with the position signal on line 64 and a correction signal appears on lead 49 at the output thereof, which signal is passed on line 65 through contacts of relay X which are now closed. The correction signal on line 65 is used as an input to a summer 87 having an amplifier of gain unity, and fed, via lead 88 at the output thereof, into a power amplifier 90 which generates on line 28 a speed reference signal for the screwdown controller of stand $S_1$. Thus, the out-of-range condition on line 26 has caused energization of relay X by actuation of relay PR, or relay NR, and relay X has caused a control signal to appear on line 65 and line 28 for providing range gauge correction. Such screwdown motion on stand $S_1$ is effected to an extent determined by the gauge reference on line 20 from the X-ray gauge device 14 and in the direction corresponding to the sign of the saturated state of the AGC circuit 22 as shown on lead 37. Moreover, during such screwdown correction, the screwdown tachometer of stand $S_1$ provides feedback action via lead 29 and lead 64, as just stated.

An additional refinement appears on FIG. 4 in that the roll force sensor LC provides on lead 31 an input to the mill stretch function generator 32, and the transform function appears on lead 33 as an input to a mill stretch memory integrator 70 which includes a circulating loop 72, 74 including a non-inverting isolation amplifier 73 back to another input thereof. When relay X is energized, break contacts at the two inputs of integrator 70 are open, but the mill stretch value stored is used on line 71 with the input on line 75 as a second input to a summer 80 providing change in mill stretch during range correction, on lead 81. After calibration by circuit 82, an amount of mill stretch correction is derived from potentiometer 84 on lead 85 and applied via close contacts of energized relay X as a second input on lead 86 to summer 87, earlier mentioned.

FIG. 4 also typically shows a number of relays and/or out-of-range condition detecting devices, which determine the operation of relay X. The latter, when energized, provides for the generation of the screwdown control signal, or range gauge correction, and the mill stretch correction just-mentioned. The relay and/or detector controlling circuits will now be described by reference to FIG. 4.

Four relays $N_1$, $N_2$ (for the negative polarity) and $P_1$, $P_2$ (for the positive polarity) are mechanically connected with normally open contacts $N_1$, $N_2$, $P_1$, $P_2$, respectively, which each determine the energization, or deenergization, of respective relays NR (AGC circuit 22 saturated negatively) and PR (AGC circuit 22 saturated positively). Saturation occurs when the speed reference, as set for the workpiece being processed and defined on lines 12 and 12*a* to the AGC circuit 22 becomes out of proportion by comparison with the gauge reference defined on line 16 to the AGC circuit. Such proportion is predetermined. Typically, saturation occurs when a proportion of 10% is exceeded in either direction, namely for positive or negative corrective action. With a deadband so defined, the range controller is set to operate within narrower limits. Typically, the out-of-range condition causes range correction to be effected when the AGC circuit is only at 60% from saturation (6 volts of 10 volt maximum), while such range correction (negative or positive) should be terminated, and normal AGC by speed resumed, as soon as the AGC circuit is at 40% from saturation (4 volts from 10 volts maximum. From line 26, the out-of-range condition is derived and used as an input to any of comparators $CPN_1$, $CPN_2$, $CPP_1$ and $CPP_2$. Each of these comparators receives a second input representing the positive and negative limits $LP_1$, $LP_2$, $LN_1$, $LN_2$ after potentiometers establish typically 60% (for $P_1$ and $N_1$) and 40% (for $P_2$ and $N_2$) of the limit. Typically, if 10 volts is the maximum or minimum voltage, $\pm 6$ volts and $\pm 4$ volts are the repetitive second inputs of the various comparators. As shown in FIG. 4, the minus limit for relays $N_1$ and $N_2$ has been inverted, and the plus limit for relays $P_1$ and $P_2$ has also been inverted, for the purpose of comparison with the first input signal on lines 24, 26. Considering the associated holding contacts, actuation of relays NR and PR is clear from the just-described circuit elements.

The screw correction signal on line 28 is obtained from lines 20 and 37, by multiplying the strip gauge, or actual thickness, of the metal strip after stand 2, by the output voltage (typically 60% of saturation, or $\pm 6$ volts as illustrated) of the AGC circuit 22 on line 37. Thus at the output of multiplier 38 a signal is obtained indicating that a range correction is to be made by moving the screws of stand $S_1$ in a direction corresponding to the polarity on line 37 by a proportional percentage (typically 10%) in the strip gauge coming out of stand S. It is important that range control only be permitted to move the stand screw setting a maximum percentage of the stand gauge out of stand S (FIG. 1) or out of stand $S_2$ (FIG. 2 or FIG. 4). Otherwise, the work rolls of the stand under screwdown correction might go off the strip or pinch the strip by excess of range control correction. The multiplier 38 (FIG. 4) by combining the output voltage of the AGC circuit 22 by the gauge reference setting of the gauge device (line 20) effectively limits range control, so that, regardless of the mill setting in relation to workpiece to be processed, the above excessive correction may be prevented. It is observed here that the strip gauge coming out of stand 1 should actually be used, but this is not necessary and the X-ray gauge available after stand 2 in certain installations could be used. The transport time from stand $S_1$ to the location of the X-ray gauge 14 after stand $S_2$ must be accounted for.

Figure 5:
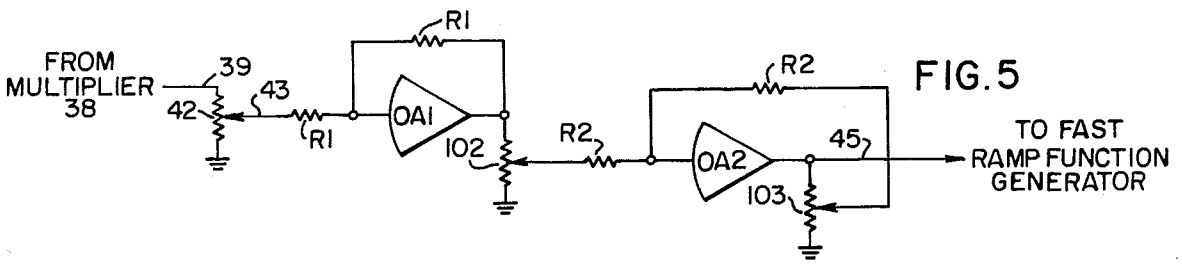
FIG. 5 shows in detail the calibration portion of the screw setting correction loop of FIG. 4.

The strip gauge signal on line 20 is generally in digital form. A digital to analog converter 35 is provided as shown in order to generate a corresponding analog signal on line 36 as an input to multiplier 38. A fraction of the output from multiplier 38 on lead 39 and potentiometer 42 is derived on lead 43 to a calibration circuit 44 shown in detail on FIG. 5. Potentiometer 42 is adjusted for 10% of the maximum strip correction signal that can be available. Two successive operational amplifiers $OA_1$, $OA_2$ with attenuation and amplification potentiometers 102, 103, effectively provide a calibrated signal on line 45 which gives 1 volt/mil correction.

Figure 6:
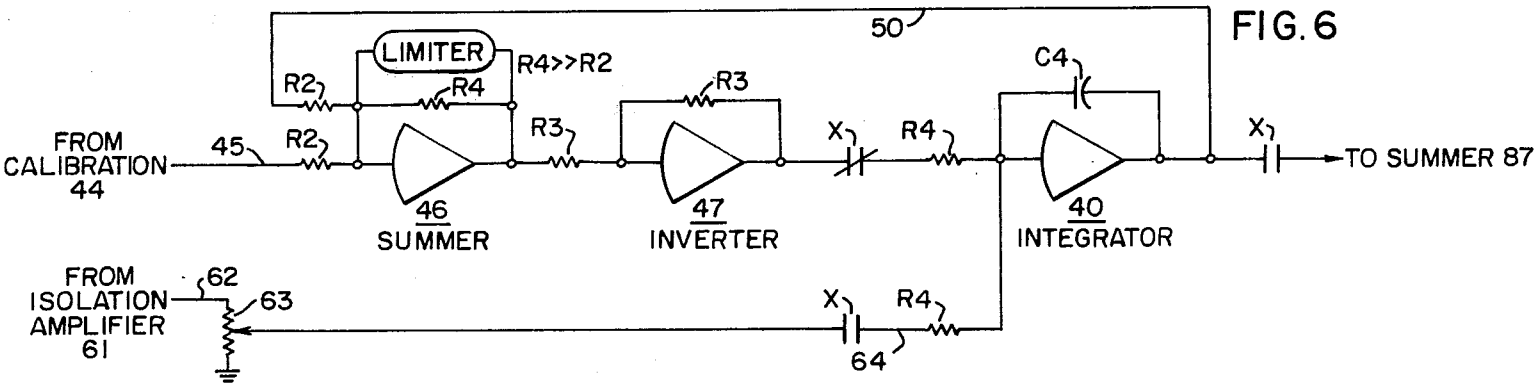
FIG. 6 shows the fast ramp function generation of the screw setting correction loop of FIG. 4.

The range correction signal on line 42 is stored on the output signal of the integrator 40 of the fast ramp function generator including a high gain summer 46, an inverter 47 and the position loop integrator 40 of FIG. 4. The fast ramp function generator is shown in detail on FIG. 6. While contacts X of relay X are closed between inverter 47 and integrator 40 the input calibrated range correction signal is circulated therethrough via feedback line 50 and continuously stored at the output 49 by capacitor C4.

Figure 7:
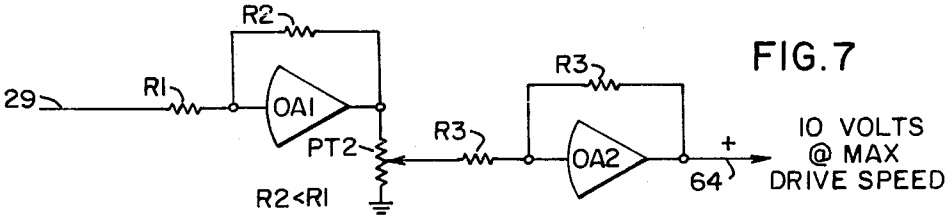
FIG. 7 illustrates an isolation transformer as can be used to receive signals from the stand screw tachometer or of the stand main drive in FIG. 4.
Figure 8:
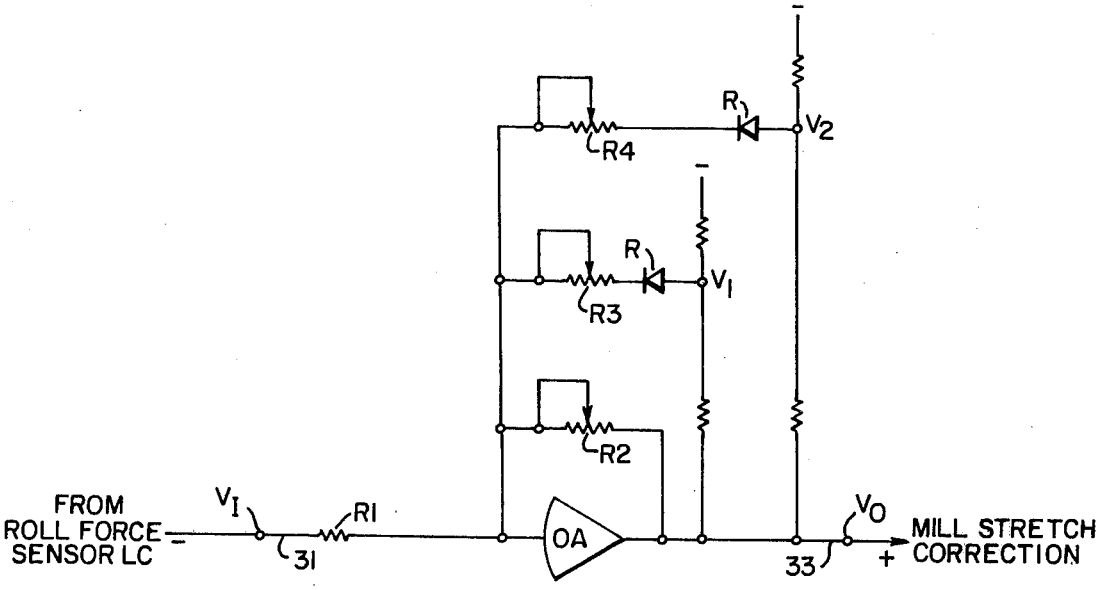
FIG. 8 shows the mill stretch function generator and FIG. 9 the function generated by the circuit of FIG. 8.
Figure 9:
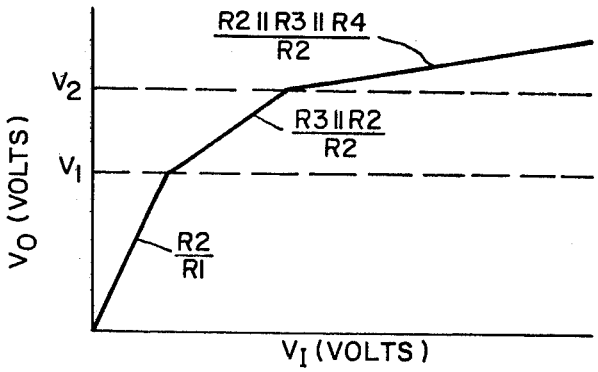

Integrator has a second input on lead 64 when open contacts of relay X are closed. The signal derived on lead 64 is provided by the screw tachometer T on line 29 via a tachometer isolation amplifier 61 shown in detail by FIG. 7. The calibrated signal, as adjusted by potentiometer $PT_2$ between the output of operational amplifier OA, and the input of operational amplifier $OA_2$, has a maximum magnitude typically of 10 volts representing screw drive speed, as earlier stated by reference to FIG. 4. As generally known operational amplifier has a feedback resistor $R_2$, where $R_2 < R_1$. Operational amplifier $OA_2$ has a unit gain as indicated by resistor $R_3$. Referring to FIG. 8 the mill stretch function generator 32 is shown in detail. $R_1$ is the resistor at the entry of operational amplifier OA and $R_2$, $R_3$, $R_Y$ being the feedback resistor inserted successively in parallel when rectifiers R become conducting under an increased output voltage $V_1$, $V_2$. FIG. 9 shows the curve representing the function 6 generated at the output 33 when the input voltage on line 31 increases.

Figure 10:
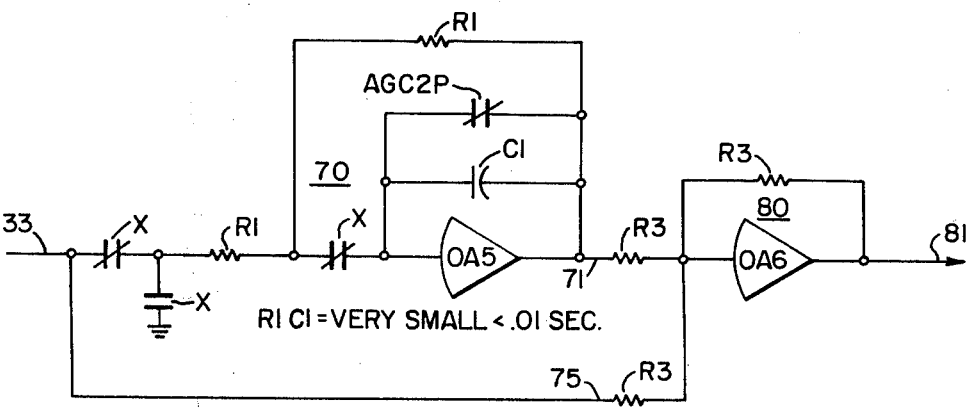
FIG. 10 shows the mill stretch memory integrator used in the mill stretch correction loop of FIG. 4.

Circuits 70 and 80 of FIG. 4 are shown in detail on FIG. 10. This is a conventional circuitry which is self-explanatory. It is noted that $R_1C_1$, the time constant of the integrator 70 is very small, typically less than .01 sec. Open and break contacts of relay X are shown in circuit at the entry of integrator 70. Break contacts $AGC_2P$ of a relay $AGC_2P$ which is a permissive relay provided on the installation which when deenergized deactivates every critical portion of the equipment. Open contacts $AGC_2P$ are also shown between the bus lines of relay X.

Figure 11:
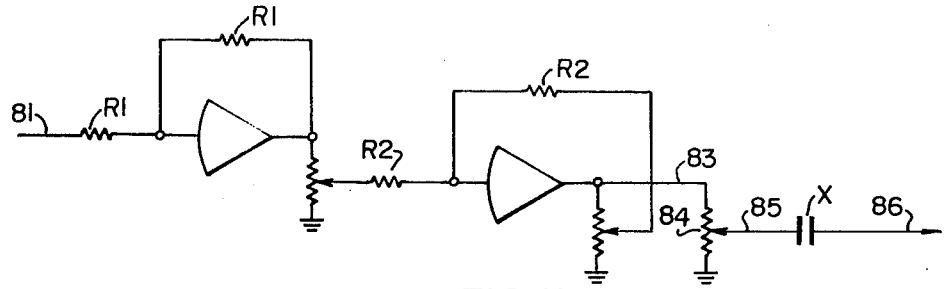
FIG. 11 is the calibration circuit used in the mill stretch correction loop of FIG. 4.

Referring now to FIG. 11 the calibration circuit 82 of FIG. 4 is shown in detail. This circuit is well known and similar to the calibration circuit of FIG. 5, earlier described.

Figure 12:
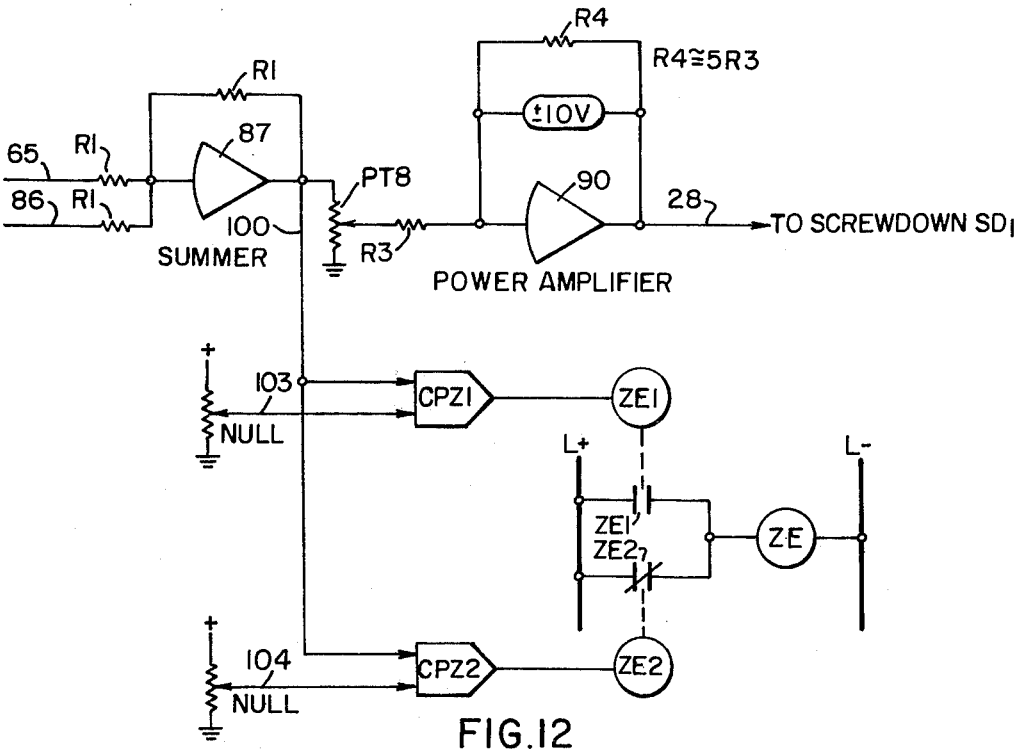
FIG. 12 shows the summer and position loop power amplifier of FIG. 4.

FIG. 12 relates to the correction summer 87 and the power amplifier 90 which generate on lead 28 the screw correction reference signal for the screwdown SD, of stand $S_1$. The potentiometer $PT_8$ at the output of operational amplifier 87 (which has a unit gain as shown) offers the possibility of adjusting the position loop gain so that the output on lead 28 10 volts represent the maximum screw speed.

From the output of summer 87 is derived on line 100 a signal which is compared for each polarity with a zero reference at 103, 104. The comparison is done by zero error detectoers CPZ1 and CPZ2 which cause the energization of a corresponding relay $ZE_1$ (positive polarity) or $ZE_2$ (negative polarity) when zero error is detected on line 100. In such case the screwdown of stand $S_1$ has effectively minimized the error which had caused saturation of the AGC circuit 22. When relay $ZE_1$ or $ZE_2$ are energized, normally those contacts $ZE_1$ and $ZE_2$ are as shown and a relay ZE is energized indicating that correction by screwdown on stand $S_1$ is in the making. Energization of relay ZE via contacts $ZE_1$ occurs when a negative appears at the output of operational amplifier 87 (FIG. 10). Deenergization of relay ZE occurs when screw correction via lead 28 is completed, e.g., when the output of operational amplifier 87 (FIG. 12) has become zero, thus causing CPZ2 to actuate relay $ZE_2$. When relay ZE falls down, denoting zero error, relay TDA is deenergized, correction via line 28 is interrupted by relay X being deenergized and the transport time delay circuit (FIG. 13) is reset. Break contacts of relay ZE are shown in FIG. 4 in circuit with relay TDA which is deenergized when the contacts open. Operation of relay TDA will now be considered by reference by reference to FIG. 13.

Figure 13:
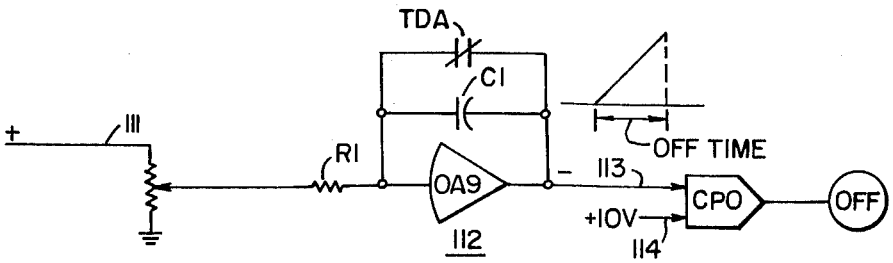
FIG. 13 is the transport timer integrator used with the circuit of FIG. 4.

FIG. 13 shows the transport timer integrator which is used in order that correction at stand $S_1$ be effective at the location of the X-ray gauge 14.

The main drive of stand $S_1$ (motor $M_1$) is provided with a tachometer 110 from which a speed signal is derived on lead 111 to the transport timer integrator 112. The latter includes an operational amplifier $OA_9$ having an integrator time constant $R_1C_1$ as shown. A comparator CPO detects when the output 113 has reached a maximum value by reference to a signal on line 114. When the maximum has been reached an OFF relay is energized which results in interrupting the energizing circuits of relays X and TDA. Relay TDA is the transport time relay which is triggered; when the AGC circuit 22 saturates (PR, or NR closes). Indeed, an isolation amplifier is provided between the main drive tachometer and the input of operational amplifier $OA_9$. Such isolation amplifier may be as shown in FIG. 7.

Operation of the preferred embodiment of the invention by reference to FIGS. 4 to 13 is as follows:

The AGC circuit 22 provides a speed correction signal to the Speed Regulator $SR_1$ of stand $S_1$ to correct strip gauge error as measured by gauge 14 after stand $S_2$. The strip gauge is primarily corrected in the roll bite of stand $S_2$. This is accomplished by varying the speed of stand $S_1$ which changes the strip tension between stands $S_1$ and $S_2$ which in turn changes the roll force on stand $S_2$. When stand $S_2$ roll force is changed, the mill stretch changes in the direction to correct the strip gauge error after stand $S_2$. If this 1–2 strip tension change exceeds a preset amount, 1–2 tension regulator 15 by screws will sense the change in the strip tension between stands 1 and 2 and move the screws on stand 2 in the direction to prevent interstand 1–2 tension from becoming too high or too low. Stand $S_2$ screw motion will be in the direction to change stand $S_2$ roll gap to correct the strip gauge error leaving stand $S_2$.

The amplifier within the AGC circuit 22 is only allowed to change stand $S_1$ speed by a maximum amount, typically ± 10% of stand 1 operating speed reference. When a greater speed change is called for, the AGC circuit 22 saturates and no further correction is made to bring the strip out of stand 2 on gauge. In such case, the range controller initiates mill action to bring the AGC circuit 22 out of saturation.

Since the range control is changing the strip gauge coming out of stand $S_1$, the range control feedback loop (line 29) has a transport time delay which represents the time a particle of strip leaves the roll gap of stand 1 and passes over the entry X-ray gauge 14 after stand $S_2$ (approximately 25 ft. of strip). This transport time delay varies with stand $S_1$ speed (strip speed between stand 1 and 2) and stand $S_2$ speed (strip speed between stands 2 and 3). Mathematically, the transport time delay is given by the following equation:

$$\text{Transport time delay} = \frac{L_{12}}{V_1} + \frac{L_{29}}{V_2}; \qquad 1)$$

seconds where, $L_{12}$ = Distance between roll gaps of stand 1 and stand 2, feet $L_{29}$ = Distance between roll gap of stand 2 and entry gauge, feet $V_1$ = Strip speed between stand 1 and stand 2 which is proportional to stand 1 speed, Ft./Sec.

$V_2$ = Strip speed between stand 2 and stand 3 which is proportional to stand 2 speed, Ft/Sec.

This transport time delay can be approximated by the following equation:

$$\text{Transport time delay} = \frac{L_{12} + L_{29}}{V_1}; \qquad 2)$$

seconds Since $V_2 > V_1$, the transport time delay given by Eq. 2 is approximately 15% higher than that given by Eq. 1 which is in the direction to make the range control more stable if Eq. 2 is used to calculate the transport time delay.

Equation 2 is synthesized by having stand $S_1$ main drive tachometer 110 send a voltage signal via line 111 to a transport time integrator (FIG. 13) which will cause the integrator output voltage to increase from zero volts when the transport timer is energized to a higher voltage level and the time to make this voltage excursion is the transport time delay given by equation 2. The transport time cycle only starts after a range correction has been made. Only after the transport time cycle ("OFF" time) is completed can range control cause another screw correction on stand $S_1$ screws. If the AGC circuit 22 has been brought back into range, the transport timer is "shut off" (relay TDA deenergized) until the AGC circuit 22 goes out of range again and another range screw correction is made.

An out-of-range condition is detected on line 26 and range detectors (NR = Negative Voltage out of range, and PR = Positive Voltage out of range) will typically pick up at approximately 60% of the maximum saturation level of the entry AGC controller and not drop out until the AGC circuit 22 output voltage on line 24 decreases to approximately 40% of the maximum saturation level of the AGC circuit. Since range control correction is initiated at a 60% controller saturation level and is kept on until the controller level goes below a 40% saturation level, the AGC circuit 22 usually never saturates except when the AGC system is initially turned on. Thus, the faster entry AGC by speed system $SR_1$ is usually able to regulate the strip gauge coming out of stand $S_2$.

The screw correction signal (line 28) is obtained by multiplying the strip gauge reference signal on line 20 as taken from stand $S_2$. X-ray gauge 14 as set by the output voltage of the AGC circuit 22 as it appears on line 37 at the time out of range condition requires range correction to be made by moving stand $S_1$ screws. This signal represents a percentage change in strip gauge coming out of stand 1. The product signal is stored on the output 41 of integrator 40 of the fast ramp function generator (Relay X deenergized) since the output of the fast ramp follows this product signal. When a range screw correction is to be made, relay X is energized and the output of the ramp function generator integrator 40 (position loop integrator) then represents the roll gap correction to be made in stand 1. At the same time, stand $S_1$ screw tachometer signal is applied by relay X via line 64 to the screw position loop regulator 40. The screw position loop integrator output signal is applied as a speed reference signal to stand $S_1$ screw speed regulator (through the correction summer 87 and power amplifier 90) by lead 28.

Moving stand 1 screws a given distance does not mean that stand 1 roll gap has changed that amount because of the change in stand 1 roll force will change stand 1 mill stretch. The change in stand 1 mill stretch can be compensated for by determining the actual mill stretch. Mill stretch is determined by measuring stand roll force (LC) and this signal goes to a mill stretch function generator 32 whose output signal on line 33 represents mill stretch. Nonlinear mill stretch characteristics should be considered since the strip in stand 1 roll gap is still soft; therefore, stand 1 roll force can be low enough that stand 1 mill stretch is operating on the nonlinear portion of the mill stretch characteristics (mill stretch, Mills versus Roll Force, kilopounds) as shown in FIG. 9.

I claim:

1. In a system for controlling the gauge of strip material issuing from a rolling mill having at least one first rollstand driven at a predetermined rolling speed with a predetermined roll gap; the combination of:

automatic gauge control means responsive to strip gauge sensed after said first rollstand for controlling the feeding speed of material into said first rollstand, said automatic gauge control means having an operative range;

range control means responsive to an out-of-range condition of said automatic gauge conrol means for generating a range correction signal; and means for altering the roll gap of said first rollstand in relation to said range correction signal, thereby to eliminate said out-of-range condition and enable operation of said automatic gauge control means within said operative range.

2. The system of claim 1, with said rolling mill being a multi-stand mill, including a second rollstand after said first rollstand, said automatic gauge control means being operative on the speed of said first rollstand, a gauge sensing device being provided located after said second rollstand for providing a gauge error signal for said automatic gauge control means and a gauge reference signal for said range control means, said roll gap altering means including screwdown means operative on the roll gap of said first rollstand and responsive to said range correction signal.

* * * * *